US008683650B2

(12) United States Patent
Scicluna

(10) Patent No.: US 8,683,650 B2
(45) Date of Patent: Apr. 1, 2014

(54) UNIVERSAL BRACKET AND LUGGAGE HANDLE SYSTEM

(71) Applicant: Tumi, Inc., South Plainfield, NJ (US)

(72) Inventor: Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 13/723,593

(22) Filed: Dec. 21, 2012

(65) Prior Publication Data

US 2013/0174376 A1 Jul. 11, 2013

Related U.S. Application Data

(63) Continuation of application No. 12/254,616, filed on Oct. 20, 2008, now Pat. No. 8,359,708.

(51) Int. Cl.
*A47B 95/02* (2006.01)

(52) U.S. Cl.
USPC ..... 16/113.1; 16/405

(58) Field of Classification Search
USPC ..... 16/113.1, 114.1, 405, 427; 190/115–118, 39, 18 A; 280/37, 655.1
See application file for complete search history.

(56) References Cited

U.S. PATENT DOCUMENTS

| | | | | |
|---|---|---|---|---|
| 5,575,362 | A | 11/1996 | Franklin et al. | |
| 5,743,363 | A | 4/1998 | Rekuc et al. | |
| 5,806,143 | A * | 9/1998 | Tsai | 16/405 |
| 5,909,760 | A * | 6/1999 | Tsai | 16/429 |
| 5,927,451 | A | 7/1999 | Tsai | |
| 6,134,749 | A | 10/2000 | Kuo | |
| 6,186,295 | B1 | 2/2001 | Lin et al. | |
| 6,223,391 | B1 | 5/2001 | Kuo | |
| 6,289,554 | B1 | 9/2001 | Wang | |
| 6,347,432 | B1 | 2/2002 | Kuo | |
| 6,360,400 | B1 | 3/2002 | Chang | |
| 6,454,066 | B1 * | 9/2002 | Chen | 190/115 |
| 7,066,311 | B2 | 6/2006 | O'Shea | |

(Continued)

FOREIGN PATENT DOCUMENTS

| | | |
|---|---|---|
| CN | 2468346 Y | 1/2002 |
| CN | 2653952 | 11/2004 |

(Continued)

OTHER PUBLICATIONS

U.S. Appl. No. 12/254,616, Dec. 21, 2012 Issue Fee payment.

(Continued)

*Primary Examiner* — William Miller
(74) *Attorney, Agent, or Firm* — Jon Fallon, Esq.

(57) ABSTRACT

The invention includes a universal retractable handle assembly for attachment to luggage items of a variety of different sizes. A plurality of tubes having a fixed length can be attached to a bracket member such that each tube can extend in a telescoping manner to a different distance from the bracket member when the handle is in the extended position and thus be employed in different sizes of luggage. Additionally, a tube housing is provided which includes a tube receiving portion and reinforcing portions on an outer surface of the tube housing. The tube receiving portion is formed with an arcuate shape which corresponds with the shape of the tube member to be inserted therein. The reinforcing portions include a plurality of planar flanges which extend beyond the outer surface of the tube receiving portion to provide improved structural characteristics.

17 Claims, 6 Drawing Sheets

(56) References Cited

U.S. PATENT DOCUMENTS

| | | | |
|---|---|---|---|
| 7,082,641 | B1 | 8/2006 | Jung et al. |
| 7,374,183 | B1 | 5/2008 | Yen-Lung |
| 8,272,100 | B2 | 9/2012 | Scicluna |
| 8,359,708 | B2 | 1/2013 | Scicluna |
| 2005/0183914 | A1 | 8/2005 | Lin |
| 2006/0225981 | A1 | 10/2006 | Lin et al. |

FOREIGN PATENT DOCUMENTS

| | | |
|---|---|---|
| DE | 295 18 585 U1 | 1/1996 |
| DE | 94 12 060.9 | 9/2004 |
| JP | 2004041474 | 2/2004 |

OTHER PUBLICATIONS

U.S. Appl. No. 12/254,616, Oct. 1, 2012 Notice of Allowance.
U.S. Appl. No. 12/254,616, Jul. 13, 2012, Response to Non-Final Office Action.
U.S. Appl. No. 12/254,616, Jun. 28, 2012 Applicant Initiated Interview summary.
U.S. Appl. No. 12/254,616, Mar. 20, 2012 Non-Final Office Action.
U.S. Appl. No. 12/254,616, Jan. 24, 2012 Response to Non-Final Office Action.
U.S. Appl. No. 12/254,616, Nov. 3, 2011 Non-Final Office Action.
U.S. Appl. No. 12/254,616, Sep. 19, 2011 Response to Non-Final Office Action.
U.S. Appl. No. 12/254,616, Jun. 17, 2011 Non-Final Office Action.
U.S. Appl. No. 12/254,616, May 27, 2011 Response to Restriction Requirement.
U.S. Appl. No. 12/254,616, May 6, 2011 Restriction Requirement.
U.S. Appl. No. 13/160,233, Aug. 20, 2012 Issue Fee payment.
U.S. Appl. No. 13/160,233, Aug. 9, 2012 Notice of Allowance.
U.S. Appl. No. 13/160,233, Jul. 13, 2010 Response to Non-Final Office Action.
U.S. Appl. No. 13/160,233, Jun. 27, 2012 Applicant Initiated Interview Summary.
U.S. Appl. No. 13/160,233, Mar. 14, 2012 Non-Final Office Action.
European Search Report for EP Application No. EP09173207, dated Jan. 20, 2011.
Response to European Search Report for EP Application No. EP09173207, dated Aug. 23, 2011.

* cited by examiner

UNIVERSAL BRACKET AND LUGGAGE HANDLE SYSTEM

CROSS-REFERENCE TO RELATED APPLICATION

This application is a continuation of application Ser. No. 12/254,616, filed Oct. 20, 2008, which issued as U.S. Pat. No. 8,359,708 on Jan. 29, 2013, which is herein incorporated by reference in its entirety.

BACKGROUND OF THE INVENTION

Field of the Invention

The present invention relates generally to the field of luggage handles. Particularly, the present invention relates to a system for attaching a handle to a piece of luggage, and more particularly to a universal telescoping luggage handle system capable of being installed in luggage items of varying size. Additionally, a tube housing is disclosed having a particular geometry which provides superior strength characteristics and enhanced structural integrity.

A typical telescoping handle design for transport devices, such as wheeled luggage, often comprises two telescoping tubes, one on either side of the luggage. The telescoping tubes allow the user to extend the handle to a comfortable length while pulling the luggage. Furthermore, the telescoping tubes can also be collapsed to allow the handle to be retracted whenever it is convenient, for example when the luggage is stowed.

It is common practice for luggage retailers to provide a variety of different luggage designs or models, as well as different sizes of a given design, in order to meet consumer demand. For example, retailers typically provide both a full-size suitcase having a particular design, as well as a matching reduced-size version of the same design which can be stored in an overhead compartment of an aircraft. Each luggage model, and each size of a particular model, has a specific set of dimensions which require a specific handle design having components with corresponding dimensions. Therefore, vendors must manufacture a variety of separate parts, such as telescoping tubes of differing lengths, for each different luggage model and size. This requirement of a series of separate parts, each of which is dedicated to a single luggage model or size, increases the complexity of the manufacturing process and introduces greater variance in component tolerances thereby inhibiting quality control measures. Also, vendors are required to maintain an inventory of different size handle components to accommodate varying models and sizes of luggage which further increases the costs associated with the luggage systems known in the prior art.

Furthermore, conventional retractable handle designs are prone to denting or breakage due to the high torsional and bending loads that are frequently exerted on the telescoping tubes during use, as well as mishandling by carriers during inspection and transit. Additionally, such conventional handle designs do not provide, and in some designs may prohibit, simplified repair or replacement of a damaged tube. As a result, consumers often discard the luggage entirely, which adds to their expense and can detract from their satisfaction.

Thus, there remains a need for an efficient and effective method and system for providing a universal retractable handle assembly for use in luggage of a variety of different designs and sizes. Furthermore, there is a need for a reinforced tube housing which is less susceptible to damage due to accidental impact or forces applied during customary usage.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied and broadly described, the invention includes a method of attaching a universal retractable handle system to a variety of luggage designs and sizes.

Particularly, the invention includes a retractable handle assembly for attachment to a piece of luggage comprising a bracket member having a base portion and at least one tube receiving portion extending therefrom, the tube receiving portion having a length defining a first end and a second end with a plurality of connection locations disposed along the length. A tube is configured to be disposed within the tube receiving portion, with the tube adapted for telescoping extension with respect to the second end of the tube receiving portion. The tube can extend to a first distance when the tube is coupled to the tube receiving portion at a first connection location, and the tube can extend to a second distance when the tube is coupled to the tube receiving portion at a second connection location, wherein the second distance is greater than the first distance.

Additionally, the tube can extend to a third distance when the tube is coupled to the tube receiving portion at a third connection location, wherein the third distance is greater than the second distance. In some embodiments, the bracket member includes two tube receiving portions having a cut-out portion defined between the two tube receiving portions. Further, the base portion has a generally horizontal section and a generally vertical section forming a generally L-shape bracket member with a plurality of apertures formed in the generally horizontal and generally vertical sections. Typically, at least one fastener is inserted through one of the apertures in the generally horizontal and generally vertical sections to couple the bracket member to the luggage.

Also, the base portion can be integrally connected to the tube receiving portion such that the tube receiving portion extends parallel to the generally vertical section of the base portion. The plurality of connection locations can be configured as apertures, and the tube receiving portion can include a rib which extends around the plurality apertures to provide enhanced strength.

In accordance with another aspect of the invention, the tube is coupled to the tube receiving portion with a fastener. The fastener can be a screw having a first thread pitch proximate the tip and a second thread pitch proximate the head. Additionally, the fastener employed can be a self-drilling screw having a flat head configured for countersunk engagement with the tube receiving portion. Alternatively, the self-drilling screw can have a raised head configured to extend beyond the tube receiving portion.

According to another aspect of the invention, a tube housing for a retractable handle device comprises a tube receiving portion having an inner surface and an outer surface such that the inner surface is configured to have a shape which corresponds to a tube inserted therein. Additionally, first and second reinforcing portions are disposed on generally opposite sides of the outer surface and form a plurality of flanges extending outwardly from the outer surface of the tube receiving portion. In some embodiments the tube receiving portion is generally arcuate, whereas the first and second reinforcing portions and flanges are generally planar such that the first and second reinforcing portions are disposed parallel to each other. The tube housing is typically formed from aluminum, or alloys thereof.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF AN EXEMPLARY EMBODIMENT

Reference will now be made in detail to exemplary embodiments of the invention, depictions of which are illustrated in the accompanying drawings. The method and corresponding steps of the invention will be described in conjunction with the detailed description of the system.

The methods and systems presented herein may be used for a universal luggage handle system. The present invention is particularly suited for a universal bracket and telescoping handle assembly capable of being installed in luggage items of varying size. Additionally, a tube housing design is disclosed having a novel geometry which provides superior strength characteristics and enhanced structural integrity.

Figure 1:
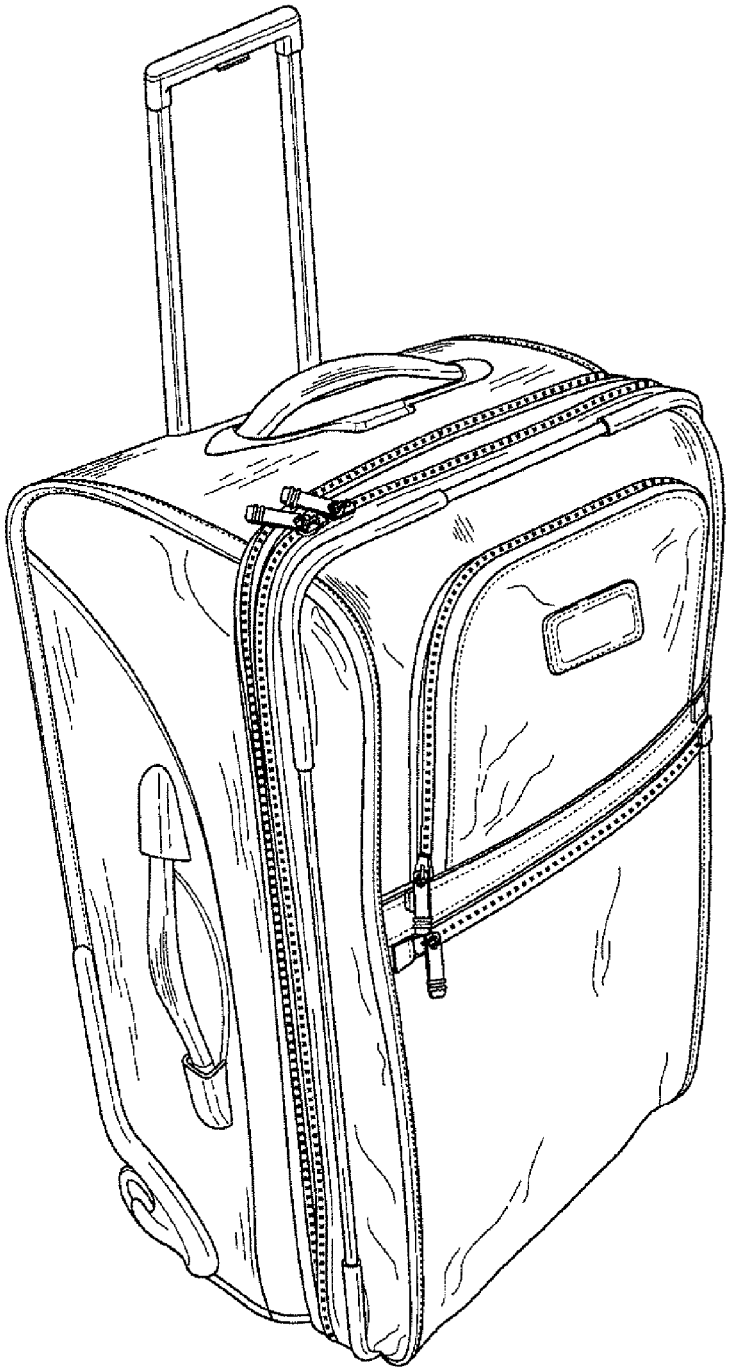
FIG. 1 is a schematic representation of an exemplary piece of luggage having a retractable handle shown in the extended position.
Figure 2:
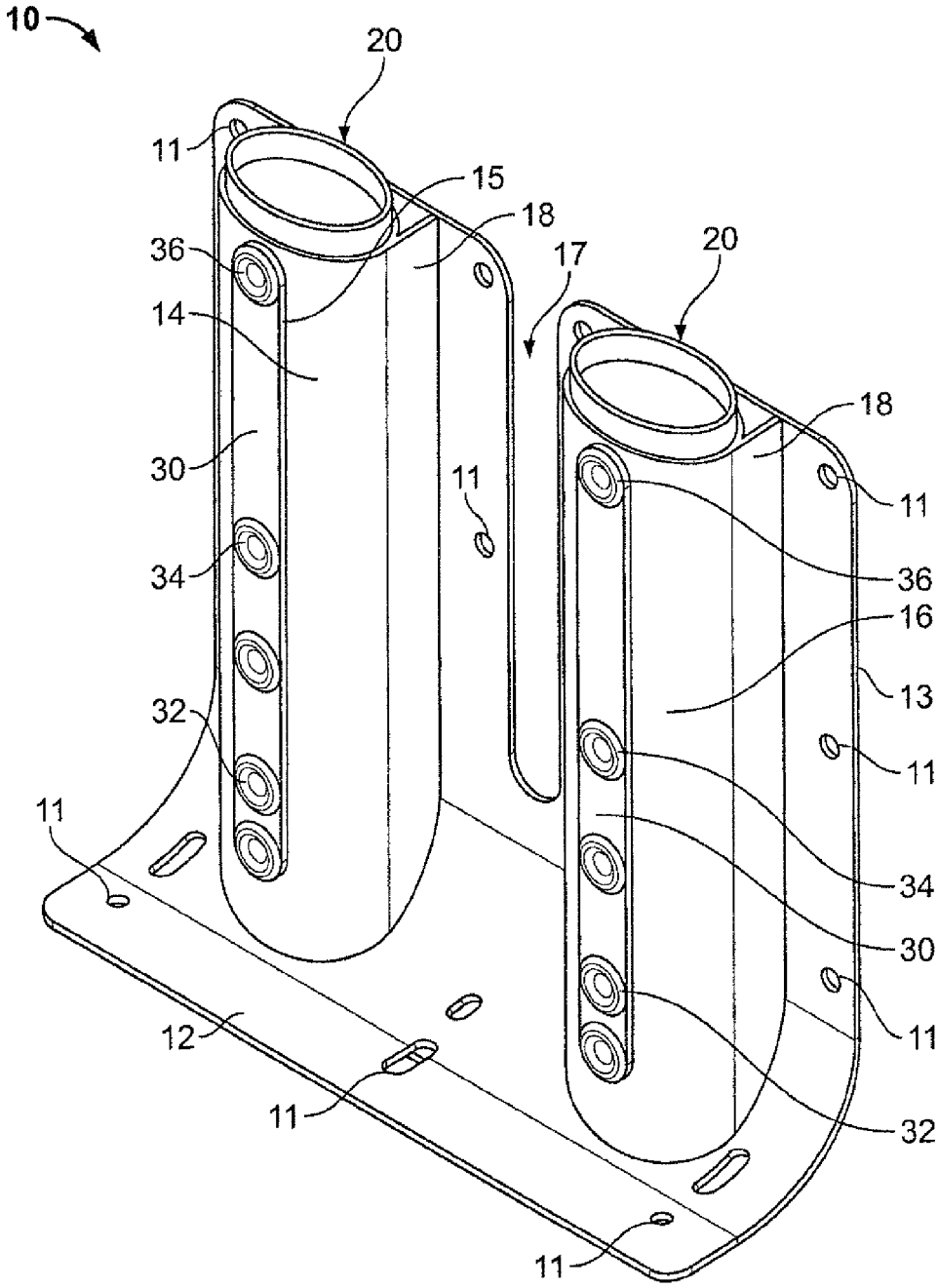
FIG. 2 is a perspective view of the bracket member with tubes inserted therein in accordance with an aspect of the invention.

For purpose of explanation and illustration, and not limitation, exemplary embodiments of the universal bracket and telescoping handle system in accordance with the invention is shown in FIGS. 1-8. FIG. 1 illustrates an exemplary item of luggage with the universal bracket and telescoping handle system of the present invention. The particular embodiment depicted in FIG. 1 shows a piece of luggage formed of relatively flexible fabric panels, however the present invention is equally applicable to luggage items having a rigid outer shell. As shown in FIG. 2, the universal bracket and telescoping handle system includes a bracket member 10 which includes two tube receiving portions 14, 16 which are configured to receive the tubes of a handle member in a telescoping manner. Although two tube receiving portions are illustrated, a bracket member 10 having an alternative number of tube receiving portions is contemplated to be within the scope of the invention.

In the embodiment illustrated in FIG. 2, the bracket member 10 has a generally horizontal base portion 12 which can be attached to a bottom section of a piece of luggage proximate the wheels, and a vertical portion 13 which can be attached to a vertical wall of the luggage, when the luggage is in an upright configuration. In some embodiments, the base portion 12, vertical portion 13, and the tube receiving portions 14, 16 are integrally connected such that the base portion 12 gradually transitions into the vertical portion 13 along a radius of curvature. Alternatively, the base portion 12, vertical portion 13, and tube receiving portions 14, 16 can be separately formed discrete members, such that the base 12 and vertical portion 13 are assembled to form an L-shaped bracket member having a 90 degree angle formed therebetween. Both the base portion 12 and the vertical portion 13 include a series of apertures 11 configured to receive fasteners to couple the bracket member 10 to the luggage. Typically, the bracket member 10 is attached to the interior surfaces of the luggage.

Additionally, in some embodiments, the bracket member 10 can have a cut-out portion 17 configured as a channel or slot defined between the two tube receiving portions 14, 16, as shown in FIG. 2. Alternatively, the bracket member 10 can have a cut-out portion configured as an aperture defined between the two tube receiving portions 14, 16. Such a cut-out portion can be advantageous in that any forces imparted on one tube receiving portion can be isolated to that portion of the bracket member and not transmitted to the other tube receiving portion. However, in other embodiments, the bracket member may be a continuous member with no cut-out portion formed between the tube receiving portions 14, 16. Such a continuous bracket member can simplify the manufacturing process and provide greater stiffness and rigidity to distribute forces during use. Further, this flexibility in design of the bracket member allows for greater customization to accommodate a larger array of luggage designs.

Figure 3:
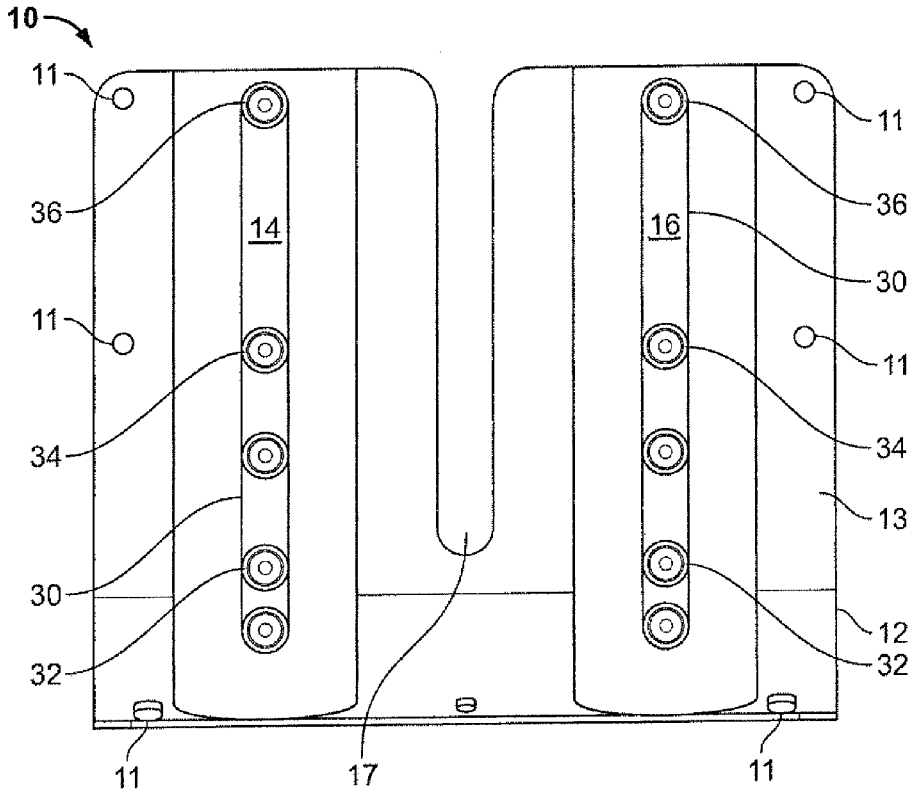
FIG. 3 is a front view of an exemplary embodiment of the bracket member.

In an exemplary embodiment, the bracket member 10 has a height extending from a first end proximate the base portion 12 to a second end of approximately 7.5 inches, and a width of approximately 7.8 inches. However, the specific dimensions can be varied to accommodate luggage containers of any size, as so desired. In a first embodiment, portions 14, 16 function as tube receiving portions and are configured to have a shape which corresponds to the shape of the tubes 20, which are typically elliptical, as shown in FIGS. 2-3. In an alternative embodiment, the portions 14, 16 function as receiving portions configured to accept a tube housing and are thus constructed with a shape which corresponds to the tube housing 40 (as shown in FIGS. 5-8 and described below). Further, each tube receiving portion 14, 16 can include planar portions 18 which extend tangentially from the edges of tube receiving portions 14, 16 to the vertical portion 13 of the bracket member. These planar portions 18 provide stability and strength to the bracket member 10 and facilitate the distribution of forces exerted on the tube receiving portions 14, 16.

Figure 4B:
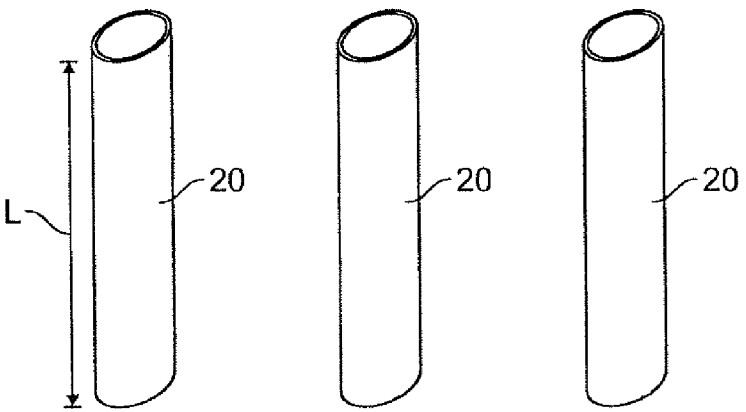
FIGS. 4A-B are exploded views of the bracket member as shown in FIG. 3 and corresponding tubes.
Figure 4A:
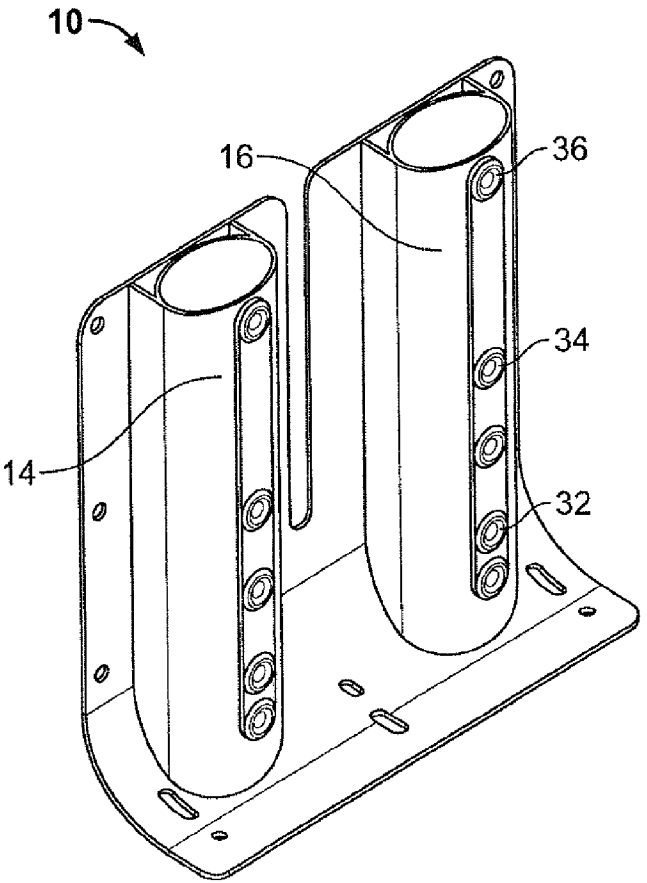

In accordance with an aspect of the invention, a plurality of tubes 20 having a fixed length can be attached to the bracket member 10 such that each tube can extend to a different distance from the second end of the bracket member 10 when the handle is in the extended position. For example and as illustrated in FIGS. 4A-B, a tube 20 having a length "L" of approximately 24 inches can be positioned within a tube receiving portion 14, 16 and attached to the bracket member 10 at different connection locations 30. The connection locations 30 are spaced apart by a distance, e.g., approximately 2 inches, which may or may not be predetermined such that the distance the tube 20 will extend from the bracket member 10 when the handle is in the extended position depends on which connection location is used to couple the tube 20 to the bracket member 10.

Therefore, a single bracket member 10 can be employed in a variety of different sizes of luggage while providing a handle member which can extend the appropriate distance from the luggage to allow a user to comfortably operate and control the luggage. For example, luggage of a first size has two tubes 20 inserted within the two tube receiving portions 14, 16 and is coupled to the bracket member 10 at a first connection location 32, as shown in FIG. 4. Similarly, luggage of a second size has two tubes 20 inserted within the two tube receiving portions 14, 16 and is coupled to the bracket member 10 at a second connection location 34 disposed above connection location 32. Likewise, luggage of a third size has two tubes 20 inserted within the two tube receiving portions 14, 16 and is coupled to the bracket member 10 at a third connection location 36 disposed above connection location 34. Therefore, the handle of the first size luggage will extend a distance of approximately 24 inches, while the handle of the second size luggage will extend approximately 26 inches, and the handle of the third size luggage will extend approximately 28 inches, with each luggage size employing tubes 20 of the same length. The connection locations 30 can be labeled, e.g., to indicate which location corresponds to a 24 inch handle extension, a 26 inch handle extension, and a 28 inch handle extension, respectively.

Although the exemplary embodiment described above describes three connection locations with uniform spacing therebetween, additional connection locations which have a different spacing are considered to be within the scope of the invention. For example, and as illustrated in FIGS. 2-4A, the tube receiving portions 14, 16 can be configured with five connection locations having a non-uniform spacing therebetween. Accordingly, a bracket member 10 having any number of connection locations, and/or alternative spacing between the connection locations than that which is depicted in the exemplary embodiments provided in the attached drawings, is considered to be within the scope of the invention. Also considered to be within the scope of the invention are embodiments in which the specific connection locations 32, 34, 36 are not predetermined and/or prefabricated within the tube receiving portions 14, 16. An example of such an embodiment is described in further detail below with respect to the use of self-drilling fasteners.

Accordingly, the tubes 20 for use in the retractable handle system of the present invention can be formed to have a common length, and yet allow the handle to extend to different distances and thus be employed in a variety of luggage sizes. Forming the tubes of a standard length is advantageous in that it requires less raw material since each tube can be formed, for example at 24 inch lengths, rather than forming a first tube length of 24 inches, a second tube length of 26 inches, and a third tube length of 28 inches. Further, forming a single size tube relieves the burden of maintaining an inventory of varying size tubes, each of which is dedicated for use in a specific size of luggage. Also, providing a universal retractable handle system for different sizes of luggage allows for cost-effective repair and replacement of damaged tubes. Thus, the universal bracket system of the present invention reduces the number of components used, which simplifies supply chain management, improves manufacturing reliability, and provides greater quality management.

Additionally, the universal bracket and handle system of the present invention can include tubes which are segmented to provide a plurality of stages of extension wherein an upper portion of the tube can be telescopingly received within a lower portion of the tube. Further, a locking feature (not shown) can be incorporated into the handle member to permit the handle to be extended a selected amount intermediate of its maximally extended position to either pull or carry the luggage, and selectively fixing the extendable and retractable handle in the best position for a particular user to pull the luggage case on its wheels. As discussed above, the maximum extended position in such embodiments is determined by which connection location is utilized for coupling the handle to the bracket member 10.

In an exemplary embodiment, the connection locations 30 are configured as apertures which are preformed in the bracket member 10 at select locations such that the tubes 20 can be inserted within tube receiving portions 14, 16 and coupled to the bracket member via fasteners. In other embodiments, the bracket member 10 can be formed without prefabricated connection locations, wherein the tubes 20 can be coupled to the bracket member via self-drilling screws which have a thread pitch which varies from the tip to the head. The use of such self-drilling fasteners is advantageous in that they provide greater flexibility in the positioning of the connection locations 30. Furthermore, less torque is required for insertion of self-drilling fasteners as compared to conventional fasteners. This reduction in torque reduces the likelihood of undesirable bending or warping of the bracket member 10 or tube 20. Further, the head can have a flat surface which lies flush with the tube receiving portion 14, 16 to establish a countersunk engagement. Alternatively, the screw can have a raised head which extends outward from the tube receiving portion 14, 16.

Furthermore, a protrusion or rib 15 can extend around the connection locations 30 to provide structural support to absorb any torque exerted during insertion of the fasteners. The rib 15 can be formed with a generally oval shape and extend along the height of the tube receiving portion 14, 16 such that a single rib 15 surrounds all of the connection locations 30, as shown in FIGS. 2-4. Alternatively, a plurality of ribs 15 can be provided to surround the entire periphery of each connection location 30. In some embodiments, the rib 15 is positioned proximate to the connection locations 30 such that the fastener head is tightened to engage the rib 15 and is prevented from directly contacting the tube receiving portions 14, 16 when the fastener is inserted into a connection location.

Figure 5:
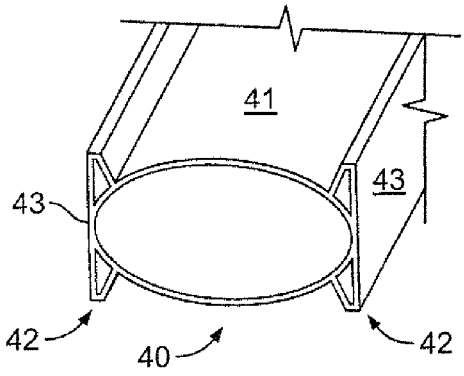
FIG. 5 is a perspective view of the tube housing in accordance with an aspect of the invention.
Figure 6:
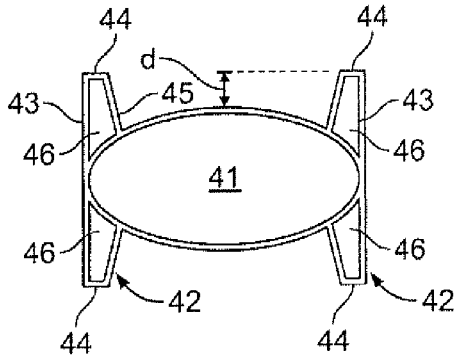
FIG. 6 is a front view of the tube housing shown in FIG. 5.

In accordance with another aspect of the present invention, a tube housing 40 is provided for use in the universal bracket and luggage handle system described above, as well as other systems. An exemplary embodiment of the tube housing 40, as illustrated in FIG. 5, includes a tube receiving portion 41 and reinforcing portions 42 on an outer surface of the tube housing. The tube receiving portion 41 is formed with an arcuate shape which corresponds with the shape of the tube 20 to be inserted therein. Non-limiting examples of such arcuate shapes include an oval, elliptical, circular, and gum-drop shape. The reinforcing portions 42 include sidewalls 43 arranged parallel to each other on opposing sides of the tube receiving portion 41 and extend a distance "d" beyond the outer surface of the tube receiving portion 41, as shown in FIG. 6.

Accordingly, the sidewalls 43 form a plurality of planar flanges 44 which are positioned outward of the tube receiving portion 41. Flanges 44 are connected to the tube receiving portion 41 by angled portion 45 of the reinforcing portions which define hollow cavities 46 positioned between the outer surface of the tube receiving portion 41 and the reinforcing portions 42. If so desired, the cavities 46 can be filled to provide solid and more rigid reinforcing portions 42. As illustrated in FIGS. 5-6, the exemplary embodiment of the tube housing 40 is symmetrical about a longitudinal axis as well as a transverse axis.

These reinforcing portions 42 increase the strength and enhance the structural integrity of the tube housing 40 by providing a greater resistance to bending and torsional forces. Additionally, the flanges 44 serve to protect the tube receiving portion 41 from accidental impact or denting since the flanges 44 are positioned beyond the outer surface of the tube receiving portion 41. This configuration serves to help protect the inner surface of the tube receiving portion 41 from deformation, thereby help ensuring proper receipt of a tube 20 within the tube receiving portion 41, and help allowing for uninhibited telescoping extension of the tube 20. Further, forming flanges 44 in a planar configuration is advantageous particularly when the tube housing 40 is employed in direct contact with luggage having relatively soft fabric panels since the flat surface of the flange is not prone to puncture or rip the fabric. The tube housing 40 can be formed of any material, including metals or polymers, which provide sufficient rigidity. In an exemplary embodiment, the tube housing can be formed from extruded aluminum and have a thickness between 0.02-0.04 inches.

Figure 7:
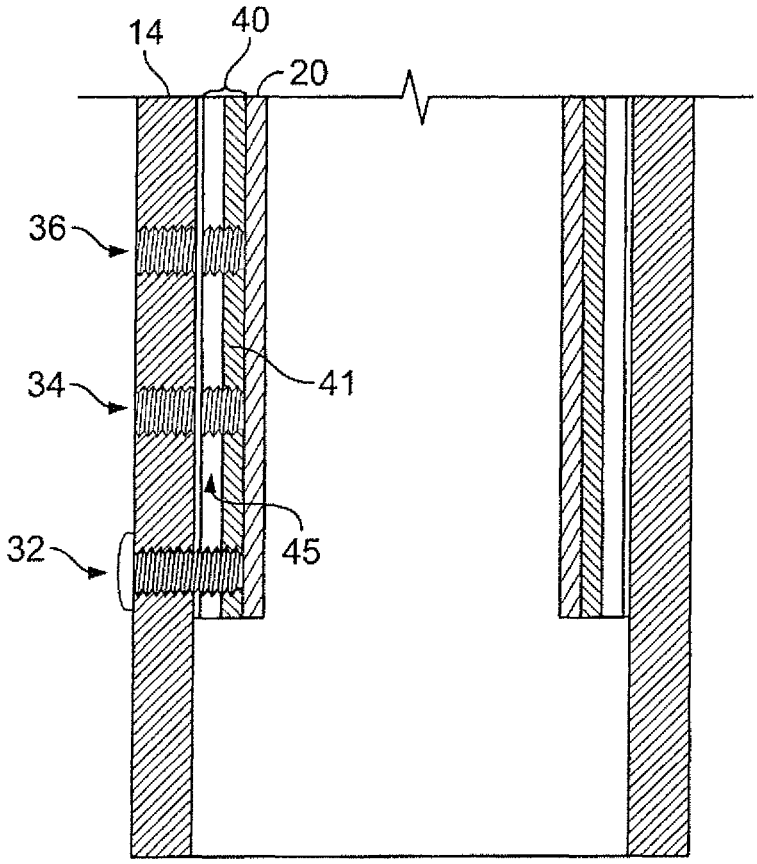
FIG. 7 is a cross-sectional view of an alternative embodiment of the invention depicting a bracket member having a tube housing and a tube positioned therein.
Figure 8:
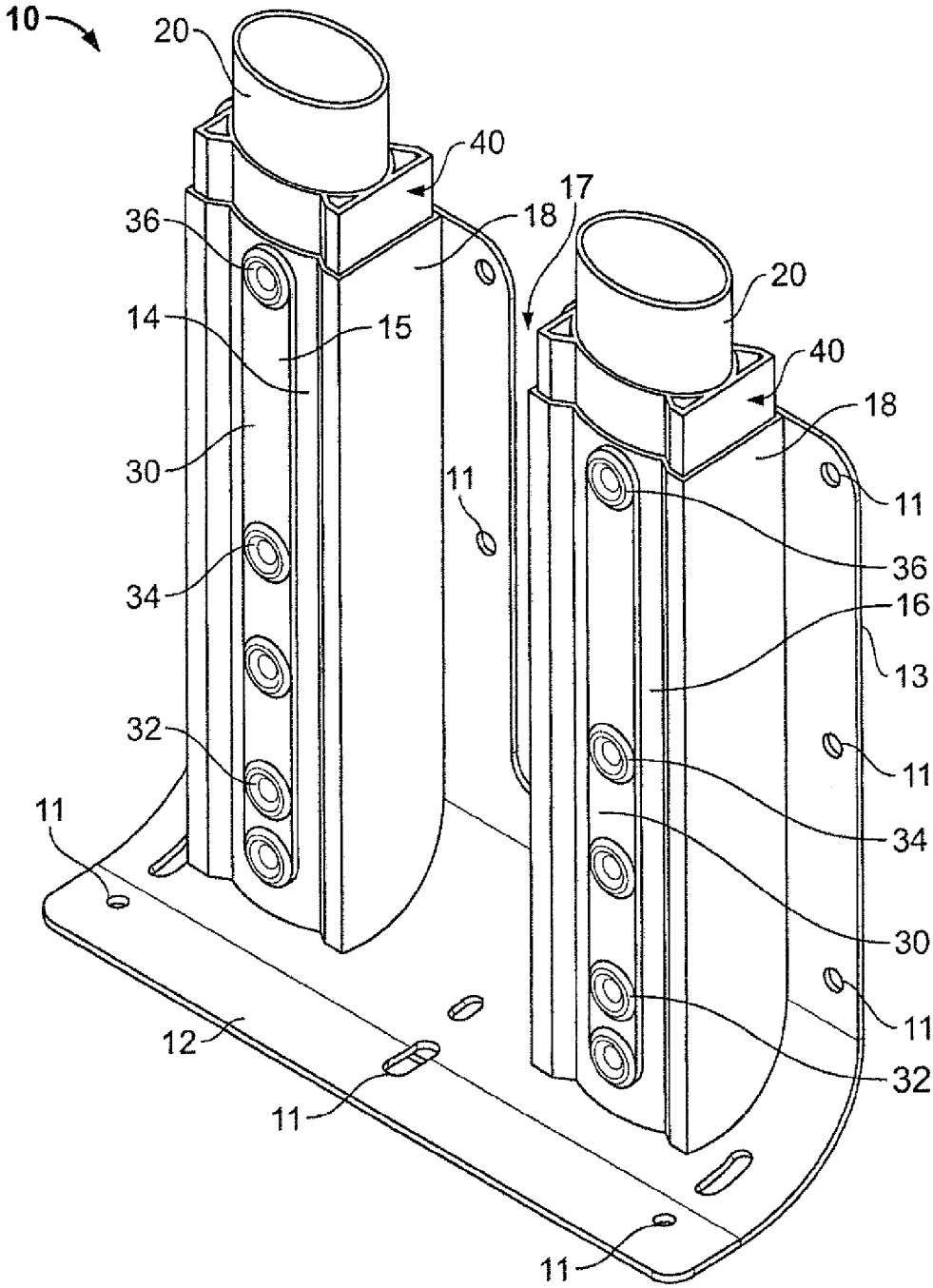
FIG. 8 is a perspective view of the embodiment shown in FIG. 7.

In an exemplary embodiment, and as illustrated in FIGS. 7-8, the tube housing 40 is positioned within the receiving portions 14, 16 of the bracket member 10 and is attached to the receiving portions 14, 16 at a connection location 30. Tube 20, which is formed of a standard length as described above, is disposed within the tube receiving portion 41 of the tube housing 40 and configured for telescoping extension so that the handle may be extended to a maximum height which is determined by the particular connection location 30 utilized. Accordingly, the luggage handle system of the present invention provides a universal bracket member 10 which receives a reinforced tube housing 40, and standardized tubes 20 which can be configured to extend varying distances from the bracket member 10, allowing for the handle system to be employed in an array of luggage sizes.

While the present invention is described herein in terms of certain preferred embodiments, those skilled in the art will recognize that various modifications and improvements may be made to the invention without departing from the scope thereof. Moreover, although individual features of one embodiment of the invention may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the invention is also directed to other embodiments having any other possible combination of the dependent features claimed below and those disclosed above. As such, the particular features presented in the dependent claims and disclosed above can be combined with each other in other manners within the scope of the invention such that the invention should be recognized as also specifically directed to other embodiments having any other possible combinations. Thus, the foregoing description of specific embodiments of the invention has been presented for purposes of illustration and description. It is not intended to be exhaustive or to limit the invention to those embodiments disclosed.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

The invention claimed is

1. A tube housing for a retractable handle assembly comprising:

a tube receiving portion having a first side and a second side and an inner surface and an outer surface, the inner surface configured to have a shape generally corresponding to a tube inserted therein;

at least a first reinforcing portion disposed on the outer surface configured to protect the tube receiving portion, the first reinforcing portion comprising a sidewall extending parallel to and extending from the outer surface of the first side of the tube receiving portion and a flange coupled to an end of the sidewall and substantially perpendicular to the sidewall; and a second reinforcing portion disposed on the outer surface configured to protect the tube receiving portion, wherein the second reinforcing portion is disposed opposite the first reinforcing portion, the second reinforcing portion comprising a sidewall extending parallel to and extending from the outer surface of the second side of the tube receiving portion and a flange coupled to an end of the sidewall and substantially perpendicular to the sidewall.

2. The tube housing of claim 1, wherein the first reinforcing portion extends a distance from the first side of the tube receiving portion at least equal to a distance from the center point of the tube receiving portion to the outer surface of the tube receiving portion.

3. The tube housing of claim 2, wherein the first reinforcing portion extends a distance greater than the distance from the center point of the tube receiving portion to the outer surface of the tube receiving portion.

4. The tube housing of claim 2, wherein the first reinforcing portion distance is measured along a line generally parallel to the sidewall of the first reinforcing portion.

5. The tube housing of claim 1, wherein the flange of the first reinforcing portion and the flange of the second reinforcing portion extend toward the center of the tube reinforcing portion.

6. The tube housing of claim 5, wherein the flange of the first reinforcing portion and the flange of the second reinforcing extend in the same plane.

7. The tube housing of claim 6, wherein the flange of the first reinforcing portion and the flange of the second reinforcing portion do not connect.

8. The tube housing of claim 1, wherein the second reinforcing portion extends a distance from the second side of the tube receiving portion at least equal to a distance from the center point of the tube receiving portion to the outer surface of the tube receiving portion.

9. The tube housing of claim 1, wherein the tube receiving portion has a generally gumdrop shape.

10. The tube housing of claim 9, wherein the first and second sides of the tube receiving portion are generally planar.

11. The tube housing of claim 10, wherein the tube receiving portion further comprises a front portion between the first and second sides, the front portion having a generally arcuate shape.

12. The tube housing of claim 1, wherein the sidewall of the first reinforcing portion and the sidewall of the second reinforcing portion are generally planar.

13. The tube housing of claim 1, wherein the sidewall of the first reinforcing portion and the sidewall of the second reinforcing portion extend parallel to each other.

14. The tube housing of claim 1, wherein at least one of the first and second reinforcing portions further comprises an angled portion extending from the outer surface of the tube receiving portion and toward the sidewall.

15. The tube housing of claim 14, wherein an end of the angled portion is coupled to one of the flange of the first reinforcing portion or the flange of the second reinforcing portion.

16. The tube housing of claim 15, wherein the angled portion, the flange, the sidewall and the outer surface of the tube receiving portion are coupled together so as to define a cavity therebetween.

17. The tube housing of claim 1, further comprising a bracket member, wherein the bracket member and the tube form the retractable handle assembly for attachment to a piece of luggage, wherein:

the bracket member has at least one receiving portion, the at least one receiving portion having a segment defined by a first end and a second end, with a plurality of connection locations disposed along the segment;

the tube housing disposed within the at least one receiving portion of the bracket member;

the tube configured to be disposed within the tube housing, the tube adapted for extending beyond the second end of the at least one receiving portion; and the tube extends to a first distance from the second end when the tube is coupled to the at least one receiving portion at a first of the plurality of connection locations, and the tube extends to a second distance from the second end when the tube is coupled to the at least one receiving portion at a second of the plurality of connection locations, wherein the second distance is greater than the first distance.

* * * * *